United States Patent [19]

Kern, Jr.

[11] 4,051,603

[45] Oct. 4, 1977

[54] FLUIDIZED BED APPARATUS

[75] Inventor: Hobart Malcolm Kern, Jr., Warren, Pa.

[73] Assignee: Struthers Scientific and International Corporation, New York, N.Y.

[21] Appl. No.: 488,637

[22] Filed: July 15, 1974

Related U.S. Application Data

[63] Continuation of Ser. No. 375,949, July 2, 1973, abandoned, which is a continuation of Ser. No. 260,148, June 6, 1972, abandoned.

[51] Int. Cl.[2] ..... F26B 17/10

[52] U.S. Cl. ..... 34/57 A; 34/102

[58] Field of Search ..... 159/4 A, 4 CC, 4 UM, 159/DIG. 3; 34/10, 57 R, 57 A, 57 D, 102

[56] References Cited

U.S. PATENT DOCUMENTS

| | | | |
|---|---|---|---|
| 3,206,865 | 9/1965 | McEntee, Jr. | 34/57 A |
| 3,251,428 | 5/1966 | Tabler | 159/DIG. 3 |
| 3,309,262 | 3/1967 | Copeland et al. | 159/DIG. 3 |
| 3,578,396 | 5/1971 | Priestley | 159/DIG. 3 |
| 3,748,103 | 7/1973 | Bean et al. | 159/4 CC |

*Primary Examiner*—John J. Camby
*Assistant Examiner*—Larry I. Schwartz
*Attorney, Agent, or Firm*—William A. Drucker

[57] ABSTRACT

In a fluidized bed dryer or reactor in which particles are coated or aggregated to form granules, oversized particles are withdrawn and separated from the product of a desired granule size, the oversized particles are pulverized, and the pulverized particles are returned to the fluidized bed for further granulation.

2 Claims, 1 Drawing Figure

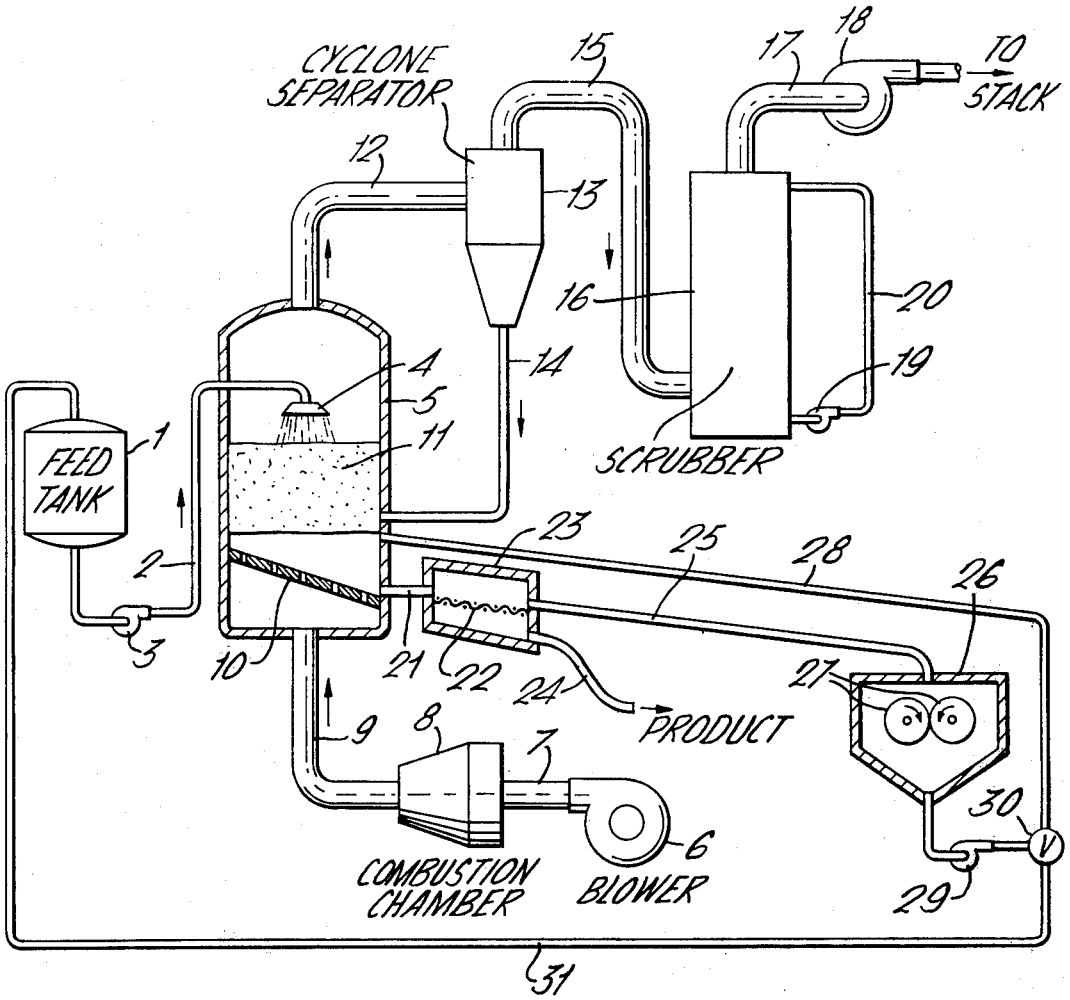
CYCLONE SEPARATOR
TO STACK
FEED TANK
SCRUBBER
PRODUCT
COMBUSTION CHAMBER
BLOWER
1
2
3
4
5
6
7
8
9
10
11
12
13
14
15
16
17
18
19
20
21
22
23
24
25
26
27
28
29
30
31

FLUIDIZED BED APPARATUS

This is a continuation of Ser. No. 375,949, filed July 2, 1973 now abandoned, which was a continuation of Ser. No. 260,148, filed June 6, 1972 now abandoned.

BRIEF DESCRIPTION OF THE DRAWING

The FIGURE is a schematic diagram of apparatus used in the practice of this invention with some elements of the apparatus shown in vertical section.

DESCRIPTION OF THE PREFERRED EMBODIMENT

Feed from tank 1 is pumped through line 2 by pump 3 to spray from a suitable nozzle 4 into the fluidized bed dryer 5. Blower 6 passes air through duct 7 to combustion chamber 8 where any suitable fuel may be burned to heat the air. Hot air passes through duct 9 to enter the bottom of dryer 5.

In dryer 5, hot air passes upward through a perforated plate 10 or the like to form a fluidized bed 11 from material sprayed into dryer 5 from nozzle 4.

Feed is usually about 50 per cent solids content. Within bed 11 water may evaporate from feed which will aggregate to form solid particles. These particles will grow as additional feed coats them and dries or particles stick together while drying. Small particles or fines will be carried off with moisture laden air through duct 12 which leads to cyclone separator 13. In separator 13 fines are separated and returned to the dryer 5 through pipe 14 for further aggregation therein into larger particles. Exhaust air passes through duct 15 to scrubber 16 from which it is exhausted through duct 17 by blower 18. Pump 19 circulates wash water in scrubber 16 through pipe 20.

A product of granules is withdrawn through pipe 21 in any conventional manner. These granules are passed through a screen 22 in chamber 23 to eliminate undesirable oversize granules from the product which is withdrawn through tube 24.

Oversize particles pass through pipe 25 to pulverizer chamber 26 which contains the crushing rollers 27. Pulverized granules as fine particles are returned to bed 11 through pipe 28 by means of pump 29.

While a fluidized bed dryer which granulates particles has been described, any other fluidized bed reactor which provides a process which granulates particles may be involved in the practice of this invention.

As an alternative embodiment of this invention, valve 30 may direct pulverized particles through pipe 31 to be recycled into the feed tank 1 where they may be dissolved in a feed solution.

While screening is shown to separate oversized granules from product granules, any equivalent separation means may be used. Any pulverized means may be substituted for the crushing rollers 27. The crushing rollers 27 may pulverize the oversize granules to any desired degree by varying their clearance or by providing one or both rollers with a knurled or otherwise irregular surface.

This invention may be used to provide aggregated dried particles of ammonium sulphate, ferrous sulphate, or ammonium phosphate.

What is claimed is:

1. Apparatus for providing product particles of a desired size in a fluidized bed dryer from an aqueous feed solution comprising:

a. a chamber to contain a fluidized bed;

b. a perforated plate beneath said bed positioned at an incline;

c. means for passing heated air upward in said chamber through said plate;

d. means for spraying an aqueous solution of feed into the chamber forming a fluidized bed therein in which drying particles aggregate and grow as they are coated and/or stick together;

e. means for separating out fines from the exhaust air from said chamber and returning said fines directly to said bed and means for subsequently scrubbing said exhaust air and removing the scrubbed exhaust air from the apparatus;

f. means at the lower edge of said plate for withdrawing aggregated particles falling from the fluidized bed;

g. means for separating large particles above a desired size range leaving product particles with the desired size range;

h. means for withdrawing product particles with the desired size range from said apparatus;

i. means for pulverizing all of the large particles; and j. means for returning the pulverized particles to the fluidized bed including means introducing pulverized particles to a tank which contains the aqueous feed solution.

2. Apparatus according to claim 4 wherein the means (f) comprises a screen which retains only particles to be pulverized above the desired size range, particles of the desired size range passing through the screen, said apparatus further including a feed tank for supplying said feed to said chamber, and means for returning at least a portion of said pulverized particles to said feed tank.

* * * * *